United States Patent [19]

Deering

[11] 4,043,897

[45] Aug. 23, 1977

[54] OIL SHALE RETORTING

[75] Inventor: Roland F. Deering, Brea, Calif.

[73] Assignee: Union Oil Company of California, Los Angeles, Calif.

[21] Appl. No.: 694,528

[22] Filed: June 10, 1976

Related U.S. Application Data

[63] Continuation-in-part of Ser. No. 465,265, April 29, 1974, abandoned, which is a continuation-in-part of Ser. No. 412,494, Nov. 2, 1973, abandoned.

[51] Int. Cl.[2] ..... C10G 1/02

[52] U.S. Cl. ..... 208/11 R

[58] Field of Search ..... 208/11 R

[56] References Cited

U.S. PATENT DOCUMENTS

| | | | |
|---|---|---|---|
| 3,106,521 | 10/1963 | Huntington | 208/11 R |
| 3,361,644 | 1/1968 | Deering | 208/11 R |
| 3,475,319 | 10/1969 | MacLaren | 208/11 R |
| 3,736,247 | 5/1973 | Jones et al. | 208/11 R |
| 3,841,992 | 10/1974 | Jones et al. | 208/11 R |

*Primary Examiner*—Delbert E. Gantz

*Assistant Examiner*—James W. Hellwege

*Attorney, Agent, or Firm*—Lannas S. Henderson; Richard C. Hartman; Dean Sandford

[57] ABSTRACT

An improved process for educing shale oil having a low arsenic content and for producing hydrogen from oil shale in high yields comprises passing the oil shale upwardly through a gas-heated pyrolysis zone to educe oil therefrom, and then passing the spent, coke-laden shale downwardly through a gasification-combustion zone to produce hydrogen-rich heating gas and/or substantially pure hydrogen for use in catalytic refining of the educed shale oil. Air or oxygen is introduced to the gasification-combustion zone to burn part of the residual coke, thereby heating the spent shale up to gasification temperatures. Steam is injected concurrently with the oxidizing gas in order to gasify unburned coke via the water gas reaction. Improved hydrogen yields and purity and more effective shale retorting are achieved by recycling hot product gas for eduction into admixture with the gasifier product between the gasification and pyrolysis zones, and eliminating recycle to the gasification-combustion zone.

14 Claims, 1 Drawing Figure

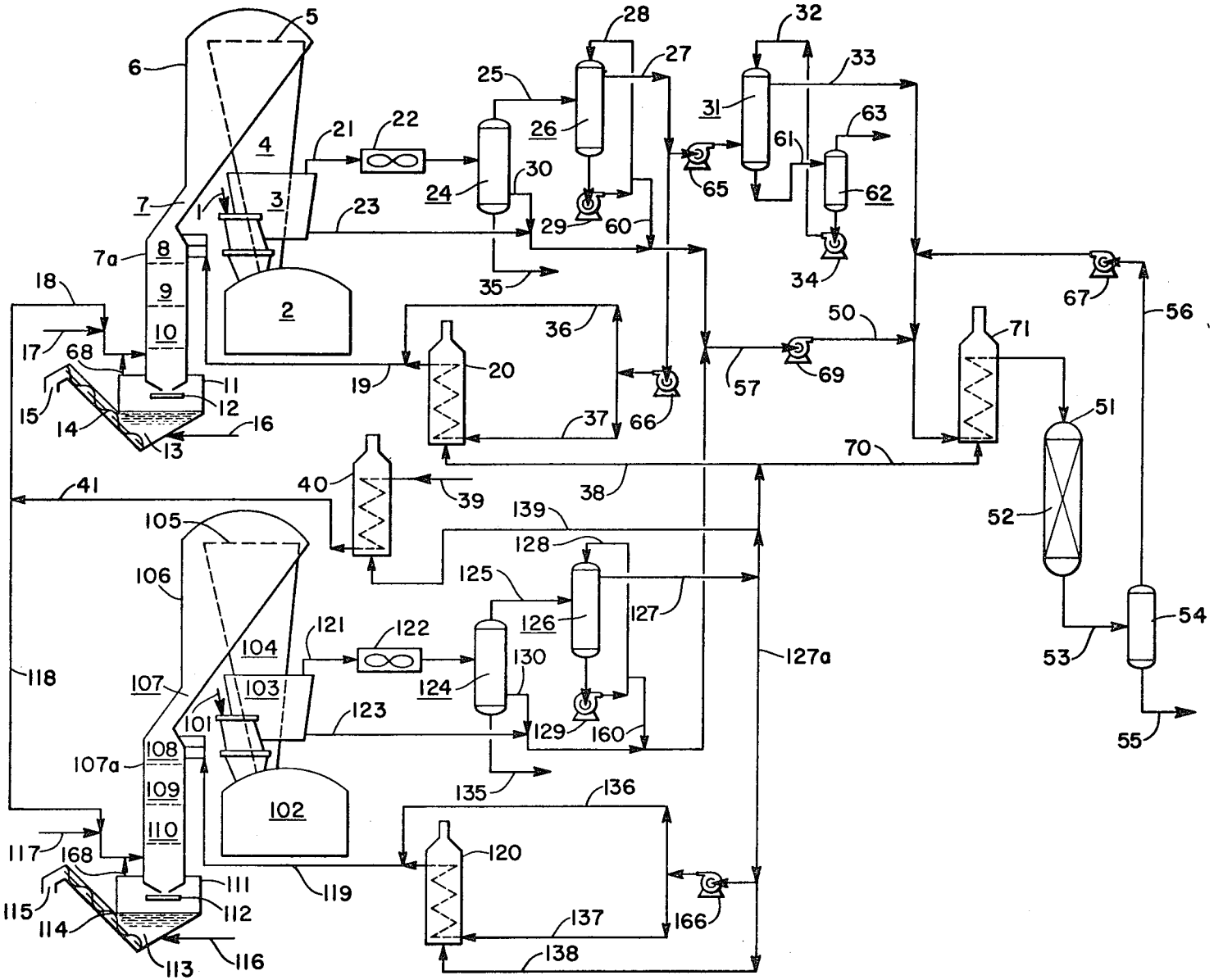

OIL SHALE RETORTING

RELATED APPLICATIONS

This application is continuation-in-part of Ser. No. 465,265, filed Apr. 29, 1974, now abandoned, which in turn is a continuation-in-part of Ser. No. 412,494, filed Nov. 2, 1973, now abandoned.

BACKGROUND AND SUMMARY OF INVENTION

A great many methods have previously been proposed for recovering oil from oil shale, nearly all of which involve some form of pyrolytic eduction. However, for a variety of economic reasons, none of these methods has yet proven competitive with the production of mineral oils from petroleum or other fossil sources. It may be said in general that the principal; overall difficulty involved in shale oil eduction resides in recovering essentially all of the hydrocarbonaceous material from the shale without resorting to prohibitively expensive methods. Since shale rock usually contains only about 20–80 gallons of oil per ton, it is a practical necessity to recover at least about 80–90 percent of this oil, and in the most economical possible fashion. It is not essential however that all of this oil be recovered as liquid product; combustible gaseous products can also be economically utilized in the eduction process itself, or in other ways. The overall objective remains to recover the maximum possible energy values at minimum expense.

Due to the expense involved in transporting raw shale rock and disposing of spent shale, it is a practical necessity in most eduction processes that the retorting facilities be located closely adjacent to the mining site. These mining sites are nearly always located some distance from refining facilities. Transporting the educed shale oil to such refining facilities has proven to be a problem, mainly because the high nitrogen content of shale oils renders them incompatible with crude petroleum and unsuited for transportation in common carrier pipelines. It would be highly desirable to provide at the retorting site at least sufficient refining facilities to convert the crude shale oil to a pipelineable material. The most desirable refining process for this purpose would be a catalytic hydrofining unit, but this has generally been considered impractical because of the expense involved in providing a suitable source of hydrogen. According to my process, a suitable such hydrogen source is integrated into the retorting system itself, thus providing the needed hydrogen at minimum expense.

Briefly, in my process, spent, coke-containing shale produced for example by the method described in my prior U.S. Pat. No. 3,361,644, is gravitated downwardly through a combusion-gasification zone, and a mixture of oxygen-containing gas and steam is passed upwardly, countercurrently therethrough. The amount of oxygen injected is controlled to burn only sufficient coke to produce the amount of heat required to initiate and drive essentially to equilibrium the endothermic gasification reactions such as:

| | | | |
|---|---|---|---|
| $2CH^1$ | $\xrightarrow{H_2O}$ | $2C + H_2$ | (1) |
| $C + 2H_2O$ | $\longrightarrow$ | $CO_2 + 2H_2$ | (2) |
| $C + H_2O$ | $\longrightarrow$ | $CO + H_2$ | (3) |

-continued

| | | | |
|---|---|---|---|
| $C + CO_2$ | $\longrightarrow$ | $2CO$ | (4) |
| $CO + H_2O$ | $\rightleftharpoons$ | $CO_2 + H_2$ | (5) |

[1]"CH" is the approximate molar composition of the original coke on the spent shale. Reaction (1) is catalyzed by water vapor.

The resulting essentially oxygen-free off-gases will be designated herein as "water gas" even though that term conventionally refers to mixtures much richer in carbon monoxide and leaner in carbon dioxide than those produced herein.

The water gas from the gasification zone is then mixed with a major proportion of preheated process recycle gas comprising mainly carbon dioxide, hydrogen and light hydrocarbons derived from the retorting zone, and the resulting hot gas mixture is then passed downwardly, countercurrently to a stream of upflowing crushed shale rock in the eduction zone to effect oil eduction by pyrolysis of kerogens. The large volume of recycle gas is required in order that the necessary heat for eduction can be supplied without preheating the smaller volume of water gas from the gasification zone to such high temperatures as to bring about undue cracking of the educed oil. High-temperature gases are also undesirable because heat is unnecessarily wasted on the decomposition of mineral carbonates in the spent shale rock.

The combined eduction gases and product oil are then recovered from the eduction zone and separated as described more in detail hereinafter. When air is used as the oxidizing gas in the gasification zone, the retort off-gas will comprise a large proportion of nitrogen and will have a relatively low heating value. Where substantially pure oxygen is employed in the gasification zone, a high Btu retort off-gas is obtained which is much richer in hydrogen, and from which carbon dioxide can be separated to produce a 70–90 percent hydrogen gas stream suitable for use in a catalytic hydrofiner to upgrade the liquid shale oil produced.

A particularly desirable modification of my process involves the use of at least one retort operating with an oxygen gasification zone, in combination with at least one retort operating with an air gasification zone. The former retort or retorts produce hydrogen for hydrofining, while the latter produces low Btu heating gas to supply the thermal requirements of the combined retorting and gasification systems.

I am aware that combined shale retorting-gasification processes have previously been proposed, for example those described in U.S. Pat. Nos. 3,577,338 and 3,736,247. However, in these processes the raw shale is passed downwardly through the retorting zone and the gasification zone, while the necessary recycle gas for eduction (comprised of product gas from the retorting zone) is introduced at the bottom of the gasification zone and passed upwardly, first through the gasification zone and then through the eduction zone. Steam and oxygen are introduced at intermediate levels to effect gasification. I have found these procedures to be disadvantageous from several standpoints. Firstly, it is difficult to maintain a sharp separation between the eduction and gasification zones. Educed oil in the top of the retort tends to reflux downwardly into the hotter gasification zone where cracking may occur, and where there may be unconsumed oxygen. But even more importantly, I have found that it is disadvantageous to pass retort off-gas through the gasification zone, for two principal reasons:

Firstly, prior to reheating for recycle, this product gas has of necessity been cooled to condense out most of the vaporized retort hydrocarbons, and concomitantly water vapor is condensed, with the result that only a low equilibrium concentration thereof remains in the recycle gas. In the gasification zone it is desirable to maintain a high partial pressure of water vapor in order, inter alia, to shift the equilibrium of reaction (5) above as far as possible to the right. If sufficient steam is added to the recycle gas to achieve this objective in the above noted prior art processes, there would be excess gaseous heat carrying capacity, both in the gasification and retorting zones. Moreover, inordinate amounts of steam would need to be generated and condensed with each pass through the system, necessarily entailing large heat losses.

Secondly, the retort product gas contains about 2–10 volume percent of light hydrocarbons which are burned preferentially in the combustion-gasification zone. The only way, in this operation, that the coke on spent shale can be utilized is by reaction with steam and carbon dioxide. It has been found that the hydrocarbons in the recycle gas suppress the gasification reactions so that less than half of the coke on spent shale can be gasified in this manner. As a result, more than 10% of the recoverable energy in the raw shale is lost to the ash discard. These considerations appear not to have been properly evaluated in prior art gasification-retorting processes.

It is accordingly an important feature of my invention to introduce the eduction recycle gas into an essentially oxygen-free transition zone maintained between the gasification and eduction zones, and in which the spent shale has not yet been heated to above about 1100° F. This permits control of the total volume of gas flowing into the pyrolysis zone so that the optimum gas to solids ratio can be obtained in this zone. The quantity of steam required in the gasification zone can be reduced and optimized since the steam requirement for gasification is less than the total volume of gas required for retorting. The temperature of the gas entering the pyrolysis zone also can be controlled and optimized. The temperature of the total gas (water gas plus recycle gas) entering the pyrolysis zone can be adjusted by controlling the temperature of the recycle gas leaving the recycle gas heater.

Another important consideration in shale retorting is the arsenic content of the produced oil. The presence of arsenic in the oil presents serious problems in the subsequent refining and use thereof. Most raw shales contain about 20–300 ppmw of As, and the educed oils may contain about 5–100 ppm thereof, depending not so much on the As content of the raw shale as upon retorting conditions.

The principal factors in retorting which appear to minimize uptake of arsenic by the oil are (1) providing a substantial water condensate phase in intimate contact with the condensed oil, and (2) minimizing the residence time of condensed oil in the retort at temperatures above the water condensation temperature, particularly in the range between about 200° and 600° F. My process provides an optimum combination of the foregoing conditions; the condensed steam from the gasification zone provides the desired water phase, and by virtue of solids-upflow, gas-downflow retorting, the retorted oil is rapidly swept downwardly, away from the hotter shale preheating and eduction zones. In solids-downflow, gas-upflow retorting however, the educed oil must be swept upwardly through the preheating zone, resulting in a refluxing condition and substantially increased residence time in the 200°–600° F zone of the retort. This condition, inherent in the above-noted prior art processes, provides increased opportunity for relatively water-soluble inorganic arsenic compounds formed during pyrolysis, e.g. $As_2O_3$, to react with aromatic oil components, forming relatively oil-soluble, water-insoluble organic compounds, which tend to remain dissolved in the oil in preference to the water condensate phase.

DETAILED DESCRIPTION

Any of a large number of naturally occurring oilproducing solids can be used in my process. The characteristics of these materials are generally well known and hence need not be described in detail. For practical purposes, however, the raw shale should contain at least about 10, preferably at least 20, and usually between about 20 and about 80 gallons of oil per ton of raw shale by Fischer assay. The shale should be crushed to produce a raw shale feed having no particles greater than 6 inches and preferably none greter than 3 inches mean diameter. Average particle sizes of about ⅛-inch to about 2 inches mean diameter are preferred.

The process may best be understood by reference to the drawing which is a schematic illustration of a preferred embodiment of this invention employing two retorting systems, each comprising shale retorting and gasification zones, and the attendant product purification and recovery systems.

Referring now to the drawing, raw crushed oil shale is fed at 1 and 101 to the respective hoppers of shale feeders 2 and 102, from which it is passed upwardly into retorts 4 and 104. The details of shale feeders 2 and 102 are described in more detail in my above-noted U.S. Pat. No. 3,361,644. The shale feed rate will, of course, vary considerably depending upon the size of retorts 4 and 104 and the desired holding time in the respective retorts.

The raw shale passes upwardly through retorts 4 and 104, traversing in each retort a lower preheating zone and an upper pyrolysis zone characterized by the differential temperatures existing in the respective zones. Temperatures in the lower portion of the retorts are sufficiently low to condense product oil vapors from the superjacent pyrolysis zone. As the shale progresses upwardly through the retorts its temperature is gradually increased to eduction levels by countercurrently flowing heating gas. Eduction temperatures are conventional, usually in excess of about 600° F, and preferably between about 700° and about 1000° F. Essentially all of the oil will have been educed from the shale by the time it reaches a temperature of about 900° F. Gas temperatures above about 1300° F in the eduction zone should not be exceeded since they result in excessive shale oil cracking. Other practicable retorting conditions include shale residence times in excess of about 10 minutes, usually about 30 minutes to about one hour, sufficient to educe the desired amount of oil at the selected retort temperatures. Shale feed rates usually exceed about 100, and are preferably between about 400 and about 1000 pounds of raw shale per hour per square foot cross-sectional area in the retort. These values refer to average cross-sectional areas in the tapered gas-downflow, solids-upflow retorts illustrated in the drawing.

Pressure in the retort may be either subatmospheric, atmospheric or superatmospheric. Retorting pressures normally exceed about 0.5 and are preferably about 0.5 to about 400 psig. Heating gas temperatures and flow rates must be sufficient to heat the crushed shale to pyrolysis temperatures. Heat transfer rates depend in large part on the heating gas flow rate, temperature and heat capacity. Flow rates of at least about 2000, generally at least about 5000 and preferably between about 5000 and about 30,000 SCF of total heating gas per ton of raw shale are employed. The temperature differential between the heating gas and solids at the top of the pyrolysis zone is usually between 10° and 100° F. Excessive temperature differentials, e.g., in excess of about 400° F, should be avoided.

The retorted oil shale exiting the top of pyrolysis zones 5 and 105 passes into hoppers 6 and 106 which are affixed as a shroud in fluid-tight fashion to the outer walls of retorts 4 and 104. From hoppers 6 and 106, the shale passes downwardly into chutes 7 and 107 to vertical gasifiers *7a* and *107a,* comprising preheating zones 8 and 108, gasification-combustion zones 9 and 109 and ash cooling zones 10 and 110. The retorted shale is essentially oil-free and will contain at least about 2%, usually between 3% and about 5%, and preferably at least 3% by weight of carbon in the form of coke.

In hoppers 6 and 106, chutes 7 and 107 and preheating zones 8 and 108, the retorted shale will ordinarily be at a temperature below about 1100° F. These transition zones are also essentially oxygen-free, and accordingly the eduction recycle gas can be introduced into any one or more of such zones.

Downflowing spent shale from chutes 7 and 107 is first preheated by direct heat exchange with the upflowing gas stream in preheating zones 8 and 108, and is then gasified in gasification-combustion zones 9 and 109 by countercurrent contact with steam and oxygen. Peak temperatures in zones 9 and 109 should be sufficiently high to react at least about 20% of the coke with steam to give hydrogen and carbon oxides. Some degree of gasification can be obtained at temperatures as low as 1000° F. However, peak temperatures above about 1100° F, preferably between about 1200° and about 1800° F are usually required to obtain feasible gasification rates. Extreme temperatures, e.g., on the order of 1800° to 1900° should be avoided to minimize carbonate decomposition and shale ash fusion, commonly referred to as clinkering. Reaction times should be on the order of at least about 5 minutes, preferably at least about 20 minutes. In cooling zones 10 and 110 the shale ash temperature is normally reduced to about 500°–800° F. The inlet temperature of the steam-oxygen mixture admitted to cooling zones 10 and 110 will ordinarily range between about 150° and 1000° F.

Steam concentrations in the gasification-combustion zones are governed by the steam addition rate to the gasifier, and corresponds to at least about 100, usually about 200 to about 1000, and preferably between about 250 and 800 pounds of steam per ton of raw shale feed.

In the preferred embodiment, combustion is supported in zone 9 associated with retort 4 by the addition of oxygen via line 17. In this embodiment steam is also introduced via lines 18 and 68 to cooling zone 10 in admixture with the oxygen. Although a portion of the required steam may be introduced directly to gasification-combustion zone 9, it is preferred that substantially all of the steam be admixed with oxygen prior to introduction into cooling zone 10. This procedure avoids the occurrence of hot spots and localized overheating, thereby minimizing carbonate decomposition and clinkering.

The oxygen concentration in the oxidizing gas introduced by line 17 should be at least about 50 volume percent and preferably exceeds about 80 volume percent. The use of cryogenic oxygen is preferred in order to minimize the introduction of noncondensable gaseous components such as nitrogen into the oxygen retort 4. The amount of oxidizing gas introduced to cooling zones 10 and 110 should be sufficient to raise temperatures of gas and solids, by combustion of coke and gas, to a temperature that will cause substantial reaction of steam with coke in gasification-combustion zones 9 and 109. Excess oxidant will cause excessive temperatures and should be avoided. Oxygen addition rates are usually in excess of about 25 pounds per ton of raw shale. Rates between about 50 and 150 pounds are preferred.

Oxygen addition rates are within the indicated ranges regardless of the composition of the oxidizing gas, provided that the oxygen concentration in the oxidizing gas is not extremely low, e.g., less than 10 volume percent. Thus, air can be added to gasification-combustion zone 110 via line 117 of the air retort 104 at rates which will give the same oxygen addition rates described above.

Spent shale ash is removed from the gasifiers by feeders 12 and 112, respectively, which also serve to maintain the desired solids level in each gasifier. The shale ash is passed into ash-steam generators 11 and 111 where it is quenched with water 13 and 113 to generate steam passed by lines 68 and 168 to ash cooling zones 10 and 110. Spent cooled ash is discharged from chutes 15 and 115 after passing through a water seal via screw conveyors 14 and 114. Makeup water can be added to ash-steam generators 11 and 111 as required via lines 16 and 116.

Shale oil is recovered from a lower portion of the raw shale preheating zones via disengaging section 3 and 103 and lines 23 and 123, and is thence passed via lines 57 and 50, pump 69 and preheater 71 to hydrofiner 51 containing fixed catalyst bed 52. If desired the raw shale oil product can be first refined to remove metals such as arsenic, and ash or other components by conventional procedures prior to hydrofining. Those procedures are well known and therefore are not illustrated in the drawing. Due to the low arsenic content of the retorted oil, generally below about 20 ppm, arsenic removal facilities can be greatly reduced in size, or in some cases eliminated altogether.

Product gas comprising hydrogen, hydrocarbons, carbon oxides and steam is recovered from disengaging section 3 via line 21 and cooler 22, and is then passed to separator 24 wherein condensed steam and condensed shale oil vapors are removed via lines 35 and 30, respectively. The condensed shale oil is passed via line 30 into admixture with the major shale oil product in line 23. The remaining vapor phase in separator 24, comprising primarily hydrogen, hydrocarbons, and carbon oxides is passed via line 25 to oil scrubber 26 wherein it is scrubbed if desired with shale oil product circulated through line 28 via pump 29 to remove residual shale oil mist from the vapor phase. Excess oil not required for the scrubber operation is passed via line 60 to product line 23 into admixture with the remaining shale oil product.

The recovered vapor phase is substantially free of shale oil mist and comprises primarily hydrogen, hydrocarbons and carbon oxides. The nominal concentration of the hydrogen stream at this point usually ranges between 10 and 40 volume percent hydrogen, about 30 to 70 percent $CO_2$, about 2 to 6 percent light hydrocarbons having up to about 8 carbon atoms and minor amounts, e.g., less than 5 percent of $H_2S$ and carbon monoxide. The net-make portion of this stream (not needed for recycle to the retorting zone) is passed via compressor 65 to absorption zone 31 wherein carbon dioxide and hydrogen sulfide are removed by selective absorption with a suitable absorbent such as methyl cyanoacetate (MCA), propylene carbonate, or the like. The absorbent is regenerated and recirculated by depressuring the same through line 61 to separator 62 from which absorbed components, e.g., carbon dioxide and hydrogen sulfide, are removed via line 63. Regenerated absorbent is recirculated to absorber 31 via pump 34 and line 32. The purified hydrogen product comprising at least about 60 and normally at least about 70 volume percent hydrogen may be further processed in a shift converter to convert the CO in the gas to $H_2$ and $CO_2$ and then, after removing the last traces of $CO_2$ is passed via line 33 and preheater 71 to hydrofiner 51.

Hydrofiner 51 may embody any one of numerous conventional hydrofining processes, e.g., denitrogenation, desulfurization, and/or hydrovisbreaking. The illustrated system comprises a fixed catalyst bed 52 which can contain any one of a number of suitable catalysts such as nickel, cobalt, molybdenum, tungsten or other metals and their oxides or sulfides supported on a suitable refractory oxide such as silica, alumina, silica-magnesia, or the like. Hydrofining conditions include temperatures in excess of about 500° and preferably about 600° to about 900° F, liquid hourly space velocities of at least about 0.3, preferably about 0.5 to about 12, and pressures of about 200 to about 3000 psig. The hydrocarbon product is recovered via line 53 and passed through cooling means not shown, and thence into separator 54 from which recycle hydrogen is recovered in line 56 and returned via compressor 67 to hydrofiner 51. Hydrofined shale oil is recovered via line 55.

Alternatively, the shale oil product in line 50 can be coked by conventional procedures to produce a saleable coke product and coker distillate fraction. The distillate can be hydrofined to remove organonitrogen and organosulfur compounds in a manner similar to that described above.

The gaseous product from air retort 104 is treated to remove condensable liquids and residual oil mist in a manner similar to the gaseous product from oxygen retort 4. However, the gaseous phase recovered from the disengaging zone 103 via line 121 will, of course, contain a substantial amount of nitrogen introduced in the air passed to cooling zone 110 via line 117. This relatively low Btu gas is cooled in air cooler 112 and passed to separator 124 wherein condensed steam is recovered via line 135. Shale oil condensate is passed via line 130 into admixture with the major oil product in line 123. The vapor phase in separator 124, containing some shale oil mist and comprising primarily hydrogen, hydrocarbons, carbon oxides and nitrogen is passed via line 125 to oil scrubber 126 wherein it is contacted with product shale oil recirculated via pump 129 and line 128. Excess oil is removed from the recirculating scrubber via line 160 and combined with the liquid product in line 123. The product gas, free of oil vapors, is to be used in part as fuel gas, and for this purpose is passed via line 127 into distribution line **127*a*, and thence via lines 38 and 138 to recycle gas heaters 20 and 120 respectively, and via lines 139 and 70 to steam generator 40 and hydrofiner preheater 71, respectively. Process steam produced in ash-steam generators 11 and 111 is transferred to ash cooling zones 10 and 110 via lines 68 and 168. Makeup water or steam is added to steam generator 40 via line 39.**

The product gas from the air retort 104 generally comprises about 10 to about 40, usually 15 to about 30 volume percent hydrogen and minor amounts, e.g., about 1 to about 5 volume percent lower molecular weight hydrocarbons having up to about 8 carbon atoms per molecule, and about 20 to about 50 percent nitrogen.

Another portion of this low Btu gas product in line **127*a* is recycled via compressor 166, line 137, recycle gas heater 120 and line 119 into admixture with the combustion and gasification products at some point between the upper extremity of combustion-gasification zone 109 and inlet 105 to retort 104. Some or all of this recycle gas can bypass heater 120 via line 136 as desired to control the temperature of the heating gas entering the pyrolysis zone of retort 104. A similar product gas recycle system is employed in conjunction with oxygen retort 4. A portion of the product gas in line 27 is passed by way of compressor 66 and line 37 to recycle gas heater 20 and line 19 into admixture with combustion and gasification products at some point between the upper extremity of combustion-gasification zone 9 and the inlet 5 to the pyrolysis zone of retort 4. Some or all of this recycle stream can bypass heater 20 via line 36** as desired for temperature control.

In both the air and oxygen retort systems the rate of recycle gas should be at least 500, usually at least about 2,000 and preferably between about 2,000 and about 20,000 SCF of recycle gas per ton of raw shale feed. These recycle rates usually correspond to volumetric ratios of recycle gas to product gas of at least about 0.1, preferably between about 0.2 and 2.0. These recycle gas streams should be recycled essentially completely to a location between the inlets of the respective pyrolysis zones 5 and 105 and the outlets of gasification-combustion zones 9 and 109. Although a minor portion, e.g., less than about 30 percent, preferably less than about 10 percent, of the recycle gas can be introduced into combustion-gasification zones 9 and 109, this practice should be minimized or avoided altogether so that combustion and gasification take place in the essentially complete absence of added hydrogen, carbon oxides or combustible hydrocarbons.

Product gas is recycled to increase the volume and heat capacity of the hot combustion and gasification products entering the pyrolysis zones. By this procedure the same amount of heat can be conducted to the pyrolysis zones at a lower temperature thereby minimizing overcracking and affording more versatile temperature control in the pyrolysis and shale preheating zones. The use of product gas recycle for this purpose also reduces steam requirements and thus results in greater economy.

Introduction of the recycle streams to an essentially oxygen-free zone downstream of the gasification-combustion zones results in numerous additional advantages. Firstly, the recycle gas is not burned in the combustion-gasification zones, and can be used more selectively for product treatment such as the shale hydrofining described above or as fuel to steam generators and recycle gas heaters. The water partial pressure in the gasification-combustion zones is correspondingly higher resulting in higher hydrogen production rates and yields.

Also, the preferred recycle procedure raises the partial pressure of steam so that lower temperatures can be maintained in the gasification-combustion zones thereby minimizing carbonate decomposition and avoiding clinkering. Acceptable gasification rates can be maintained at lower temperatures due to higher water vapor partial pressures. The consequent reduction in carbonate decomposition — due to lower temperatures — further reduces heating requirements and product gas dilution.

These methods also produce higher quality, less friable ash due to more complete carbon consumption, and spent ash handling and disposal is simplified considerably.

The following example is cited to illustrate a specific preferred commercial operation hereunder, but is not to be construed as limiting in scope:

EXAMPLE I

In this Example, 5000 tons per stream day of 34 gallon per ton (Fischer assay) crushed shale is fed to each of two gasifier-retorts similar to those illustrated in the drawing, operating at a pressure of 10 psig. Cryogenic oxygen and steam are fed to one gasifier and air-stream to the other. The principal operating conditions and results are as follows:

Table 1

| Temperatures, ° F | Oxygen Retort | Air Retort |
|---|---|---|
| Raw Shale | 60 | 60 |
| Eduction maximum (solids) | 950 | 950 |
| Eduction gas maximum | 1000 | 1000 |
| Gasification maximum (solids) | 1500 | 1500 |
| Ash from gasification cooling zones | 250 | 250 |
| Gas Rates per Ton of Raw Shale | | |
| Steam to gasification zones | 730 lbs | 510 lbs |
| Oxidizing gas to gasification zones | 95 lbs $O_2$ | 500 lbs Air |
| Recycle gas to retorting zones | 5000 SCF | 5000 SCF |
| Approximate Residence Times, Hrs. | | |
| Of shale at 800–1000° F eduction temperatures | 0.50 | 0.50 |
| Of spent shale at 1000–1500° F gasification temperatures | 0.30 | 0.30 |
| Product yields | | |
| Full-range shale oil | 3845 B/D | 3845 B/D |
| Net product gas | 35.7 MM SCF/D | 59.5 MM SCF/D |

The composition of the raw product gases (as well as the respective recycle gases) is as follows:

Table 2

| Volume-Percent | Oxygen Retort | Air Retort |
|---|---|---|
| $H_2$ | 25.2 | 15.1 |
| $H_2S$ | 0.9 | 0.6 |
| $CO_2$ | 54.7 | 32.8 |
| CO | 2.8 | 1.7 |
| $C_1$-$C_6$ | 6.0 | 3.5 |
| $H_2O$ | 10.4 | 10.4 |
| $N_2$ | nil | 35.9 |

If the respective recycle gases in the foregoing example were recycled through the combustion-gasification zones, only a small fraction of the residual coke on the retorted shale fed to the gasifier would be gasified and the yield of hydrogen would be too low to provide an economical source of hydrogen.

EXAMPLE II

This example demonstrates the effect of retorting conditions on arsenic content of the product oil. Four runs were carried out, in all cases with solids-upflow and gas-downflow in the retorting zone. In runs 1 and 2, the eduction gas was retort recycle gases; in runs 3 and 4 it was composed of a mixture of retort recycle gas and off-gas from gasifiers operating under conditions similar to those set forth in Table 1. The principal conditions and results of the runs were as follows:

Table 3

| | Recycle Gas Dry Retorting | | Gasification-Wet Retorting | |
|---|---|---|---|---|
| Run No. | 1 | 2 | 3 | 4 |
| Raw Shale Analysis | | | | |
| Fischer Assay, Gal/T | 31.3 | 37.8 | 30.6 | 31.3 |
| Arsenic, ppmw | 200 | 63 | 151 | 120 |
| Retorting Conditions | | | | |
| Temp. Max., ° F | 921 | 917 | 927 | 913 |
| Recycle Gas Rate to Retort, SCF/T | 22,500 | 11,380 | 7566 | 4775 |
| Gasifier Feed | | | | |
| Steam, lbs/T | — | — | 451 | 447 |
| Air/$O_2$, SCF/T | — | — | 788/$O_2$ | 5500/Air |
| Retort Products | | | | |
| $C_4$+ Yield, Gal/T | 32.9 | 35 | 30.8 | 41 |
| Water Condensate, lbs/T | 8 | 19 | 372 | 382 |
| Arsenic in $C_4$+ product, ppmw | 53 | 49 | 16 | 8 |

The markedly lower arsenic content of the product oil from runs 3 and 4 is readily apparent. This is believed to result from the presence of a substantial water condensate, and to the gas-downflow, solids-upflow mode of retorting which minimizes the time during which the educed oil is held at retort temperatures in the 200°–600° F range, prior to the formation of a water condensate.

Numerous variations and modifications of the concept of this invention will be apparent to one skilled in the art in view of the foregoing disclosure and the appended claims.

I claim:

1. In a process for producing a low-arsenic shale oil and a hydrogen-containing product gas wherein a stream of raw crushed, arsenic-containing oil shale is first countercurrently contacted in an eduction zone with a stream of essentially oxygen-free, hot eduction gas contaning carbon dioxide to thereby produce shale oil, an eduction off-gas and hot, essentially oil-free, coke-containing spent shale, and wherein said hot spent shale is thereafter countercurrently contacted in a gasification zone with a conversion gas mixture comprising steam and oxygen to partially combust the coke on said spent shale and thereby heat said spent shale to sufficiently high temperatures to react said steam with remaining coke, thereby producing an essentially oxygen-free, hydrogen-containing water gas, and decarbonized shale which is passed through a cooling zone communicating with said gasification zone, and wherein said eduction gas comprises a mixture of said water gas and a recycle portion of said eduction off-gas, the improvements which comprise:

1. passing said raw shale upwardly through said eduction zone;
2. maintaining an essentially oxygen-free transition zone between said eduction zone and said gasification zone;
3. passing said spent shale serially and downwardly through said transition zone, said gasification zone and said cooling zone;
4. passing serially through said cooling zone and said gasification zone sufficient of said conversion gas mixture to provide at least about 25 pounds of oxygen and at least about 100 pounds of steam per ton of raw shale, sufficient oxygen being supplied to maintain a peak temperature above about 1,000° F in said gasification zone;
5. passing said water gas through said transition zone into said eduction zone;
6. injecting all of said recycle portion of eduction off-gas into said transition zone to mingle therein with said water gas and form said eduction gas; and
7. withdrawing the non-recycled portion of said eduction off-gas as said hydrogen-containing product gas.

2. A process as defined in claim 1 wherein the peak temperature in said gasification zone is between about 1,200° and 1,800° F, and the solids temperature in said transition zone is below about 1,100° F.

3. A process as defined in claim 1 wherein said conversion gas mixture is essentially air and steam.

4. A process as defined in claim 1 wherein said conversion gas mixture is essentially steam and an oxidizing gas comprising at least 50 volume-percent oxygen.

5. A process as defined in claim 4 wherein said oxidizing gas comprises at least about 80 volume-percent oxygen.

6. A process as defined in claim 1 wherein said conversion gas mixture is essentially steam and an oxidizing gas comprising at least about 80 volume-percent oxygen, and wherein:

1. said hydrogen-containing product gas is treated for removal of carbon dioxide, thereby producing a rich-gas containing at least about 70 volume-percent hydrogen; and
2. said rich-gas is thereafter utilized to hydrofine at least a portion of said shale oil product and/or the shale oil product from another unit in which the process of claim 1 is being practiced.

7. A process as defined in claim 6 wherein at least a portion of the heat requirement for said process is derived by combustion of eduction of off-gas recovered from a second process unit in which the process of claim 1 is being practiced utilizing a conversion gas mixture consisting essentially of steam and an oxidizing gas containing between about 20 and 50 volume-percent oxygen, the remainder being essentially nitrogen.

8. A process as defined in claim 1 wherein said conversion gas mixture is essentially steam and an oxidizing gas containing between about 20 and 50 volume-percent oxygen, the remainder being essentially nitrogen, and wherein at least a portion of said hydrogen-containing product gas is combusted to provide heat for said process, and/or for another unit in which the process of claim 1 is being practiced.

9. A process for producing a low-arsenic shale oil and hydrogen in high yields from arsenic-containing oil shale in a retort comprising serial oil shale preheating and pyrolysis zones through which said shale is passed upwardly, and a gasifier comprising serial spent shale preheating, gasification-combustion, and ash cooling zones through which said oil shale is passed sequentially downwardly, said process comprising the steps of:

a. heating said oil shale in said oil shale preheating zone in countercurrent direct heat exchange with heating gas comprising a mixture of water gas from said gasifier and a recycle product gas stream hereinafter detailed;
b. passing the thus heated oil shale to said pyrolysis zone and further heating said shale with said countercurrently flowing heating gas to a pyrolysis temperature sufficient to educe said oil from said shale and produce spent shale containing coke;
c. passing said educed oil and gas to said shale preheating zone and recovering therefrom said shale oil and a product gas comprising hydrogen and carbon dioxide;
d. recycling a portion of said product gas into admixture with said water gas between said gasification and pyrolysis zone, none of said product gas being recycled through said gasification zone;
e. passing said spent shale to said spent shale preheating zone in direct countercurrent heat exchange with water gas from said gasification-combustion zone, said water gas comprising hydrogen and carbon dioxide and being essentially completely free of oxygen;
f. passing said water gas from step (e) in combination with said recycle gas stream as heating gas sequentially through said oil shale pyrolysis and preheating zones;
g. passing preheated spent shale from step (e) to said gasification-combustion zone and therein countercurrently contacting said spent shale with a conversion gas mixture comprising steam and oxygen while maintaining the rate of addition of oxygen-containing gas to said combustion-gasification zone at a level sufficient to raise temperatures of gas and solids, by combustion of coke and gas, to a temperature sufficiently high to cause said steam to react substantially with said coke and produce hydrogen and carbon dioxide;
h. passing solids from step (g) through an ash cooling zone; and
i. passing serially through said cooling zone and said gasification-combustion zone sufficient of said conversion gas mixture to provide at least about 100 pounds of steam per ton of raw shale.

10. The process of claim 9 wherein said pyrolysis temperature is between about 600° and about 1,000° F, said heating gas is passed through said pyrolysis and oil shale preheating zones at the rate of at least about 2,000 standard cubic feet per ton of said oil shale, said recycle stream is admixed with said water gas at a rate sufficient to provide a volumetric ratio of total recycle gas to product gas of at least about 0.1, said combustion-gasification is carried out at peak temperatures between about 1,200° and 1,800° F while maintaining an initial steam partial pressure therein corresponding to a steam addition rate of at least about 200 lb/ton of said oil shale and not substantially greater than 1,000 lb/ton of said shale, and wherein oxidizing gas supplied to said gasification-combustion zone corresponds to at least about 50 and not substantially greater than about 150 lbs. of oxygen per ton of said oil shale.

11. The process of claim 10 wherein said oxidizing gas contains at least about 50 volume percent oxygen.

12. The process of claim 10 wherein said oxidizing gas comprises at least about 80 volume percent oxygen.

13. The process of claim 12 which further comprises heating said recycle product gas in a recycle gas heater prior to admixture with said water gas by indirect heat exchange with the hot combustion products of a combustible hydrogen-containing gas produced by the method including the steps of:

a. preheating spent retorted shale containing coke from a second retort pyrolysis zone in a second gasifier comprising a second spent shale preheating zone through which said spent shale is passed countercurrently to and in direct heat exchange with water gas from a second gasification-combustion zone;

b. passing the preheated spent shale containing residual coke to said second gasification-combustion zone in countercurrent contact with a conversion gas consisting essentially of air and steam under oxidizing conditions sufficient to burn a portion of said residual coke and raise temperatures of gas and solids sufficiently high to cause said steam to react substantially with said coke to form said water gas;

c. passing said water gas serially through said second spent shale preheating zone and said second retort pyrolysis zone countercurrently to the flow of oil shale therethrough; and d. recovering gaseous products from said second retort pyrolysis zone and passing at least a portion of said gaseous products to said recycle gas heater as said combustible hydrogen-containing gas and combusting the same therein.

14. The process of claim 9 wherein said oxidizing gas comprises at least about 50 volume percent oxygen, said product gas is refined to remove carbon dioxide, residual volatile hydrocarbons and water, thereby producing a concentrated hydrogen stream containing at least about 70 volume percent hydrogen, and said shale oil recovered from said oil shale preheating zone is reacted with said concentrated hydrogen stream in the presence of a hydrofining catalyst under hydrofining conditions sufficient to effect substantial desulfurization and/or denitrogenation.

* * * * *